United States Patent [19]

Diggle, Jr.

[11] 4,118,841

[45] Oct. 10, 1978

[54] APPARATUS FOR COMPACTING WOVEN GAUZE BANDAGES

[75] Inventor: Edmund A. Diggle, Jr., Ho-Ho-Kus, N.J.

[73] Assignee: Compax Corp., Woodside, N.Y.

[21] Appl. No.: 774,062

[22] Filed: Mar. 3, 1977

Related U.S. Application Data

[62] Division of Ser. No. 730,313, Oct. 7, 1976, Pat. No. 4,041,581.

[51] Int. Cl.[2] ..... D06C 21/00

[52] U.S. Cl. ..... 26/18.6

[58] Field of Search ..... 26/18.6

[56] References Cited

U.S. PATENT DOCUMENTS

| | | | |
|---|---|---|---|
| 3,015,145 | 1/1962 | Cohn et al. | 26/18.6 |
| 3,015,146 | 1/1962 | Cohn et al. | 26/18.6 |
| 3,059,313 | 10/1962 | Harmon | 26/18.6 UX |
| 3,083,435 | 4/1963 | Cohn et al. | 26/18.6 |

*Primary Examiner*—Robert R. Mackey
*Attorney, Agent, or Firm*—Mandeville and Schweitzer

[57] ABSTRACT

The disclosure is directed to the mechanical compacting of woven gauze bandages. An improved bandage gauze, having increased crimp and bulk, and a desirable degree of lengthwise stretch, is produced by passing the gauze through a two-roll compactor which, in its generalities, is of a known type, but which is specifically modified and improved to enable the gauze material to be processed effectively. The compactor comprises opposed feeding and retarding rolls, forming a nip. A compacting shoe is associated with the feed roll and the roller nip so as to drive the fabric to be fed toward the nip. At the nip, the gauze is decelerated by the retarding roll, and the material is continuously and progressively gathered and compacted in a short zone between the terminal edge or tip of the shoe and the roller nip. The ability to process gauze bandage material in a two-roll compactor is made possible by the use of an unusual combination of compactor rolls, including a retarding roll formed with a diamond knurled surface and a feeding roll formed with a straight knurled surface of somewhat finer pitch than the diamond knurl of the retarding roll. The feeding roll is provided with surface-forming means at each end thereof projecting radially beyond the working surface of the feeding roll to act as a limit stop for the compacting shoe. To advantage, the compacting shoe is positioned in a spaced relation to the working surface of the feeding roll by the limit stop. This particular and unique combination enables surprising and unexpectedly superior results to be achieved in the compacting of the gauze bandage material.

2 Claims, 4 Drawing Figures

FIG. 3
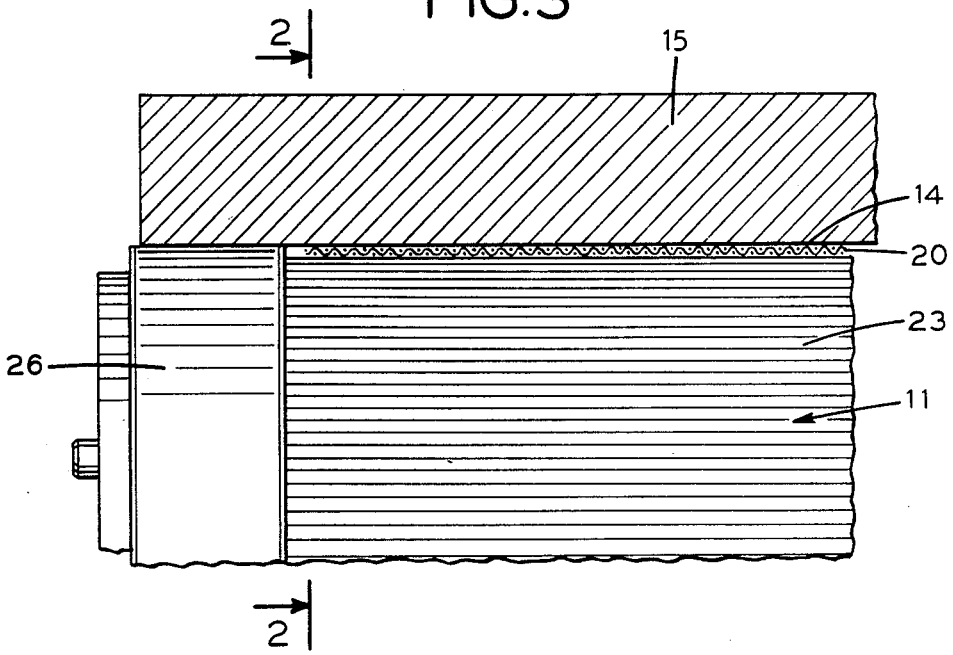
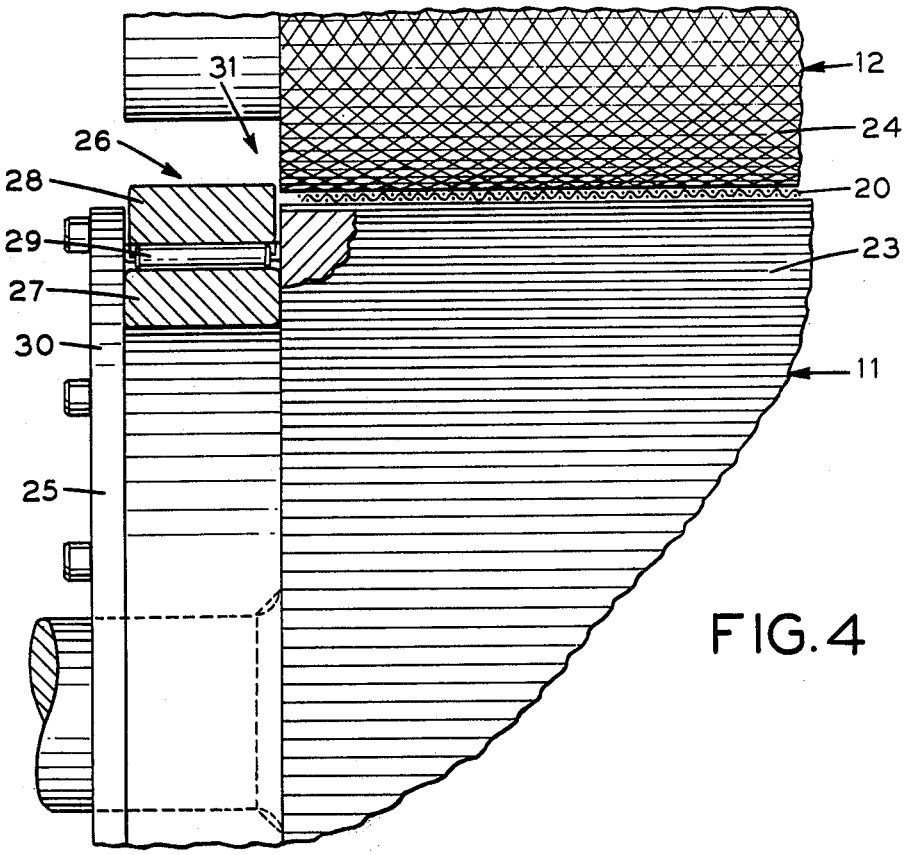
FIG. 4

APPARATUS FOR COMPACTING WOVEN GAUZE BANDAGES

This is a division of application Ser. No. 730,313, filed Oct. 7, 1976, now U.S. Pat. No. 4,041,581.

BACKGROUND AND SUMMARY OF THE INVENTION

The invention is directed to the mechanical compressive shrinkage of a specific fabric material, namely gauze bandage material utilizing a two-roll, differential speed compactor of the general type typified by the Eugene Cohn et al U.S. Pat. No. 3,015,145. In the manufacture of gauze bandages, it has become the practice to subject the woven gauze material to a substantial pre-shrinking operation, in order to achieve improved bandage characteristics for certain purposes. Principally, such a pre-shrinkage procedure has involved so-called slack mercerizing of the gauze, which is typically constructed of 100% cotton yarns, assembled in a loose, open weave. Slack mercerizing, while resulting in a functional end product, has certain unavoidable disadvantages. Among these is a relatively slow processing speed. In this respect, the slack mercerizing process involves impregnating the gauze fabric with a caustic (sodium hydroxide) solution, permitting the fabric to relax, and then washing and drying the fabric. The mercerizing chemicals constitute a water pollutant and accordingly present a disposal problem. Moreover, slack mercerizing inherently involves shrinkage in both the length and width direction, whereas in general it is the length shrinkage that is the sought-after characteristic.

Notwithstanding that many of the important disadvantages of the slack mercerizing process could at least theoretically be minimized or eliminated by mechanical lengthwise compressive shrinkage of the gauze fabric, such procedures have proved elusively difficult to achieve in actual practice, because of the need for significantly high percentages of lengthwise shrinkage, taken in conjunction with the thin, somewhat gossamer character of the gauze material. For example, overall lengthwise compressive shrinkage of at least 35% is desired, which effectively rules out stretchable belt types of compressive shrinkage equipment. On the other hand, with the fabric being constructed of cotton yarns of 30's - 40's count, utilizing typically around 20 threads per inch in the warp direction and 12 threads per inch in the filling direction, the individual webs of gauze material have little substance and present significant handling problems in roller-type shrinkage equipment, even where the gauze material is processed in multiple thicknesses.

In accordance with the present invention, it has been found that surprising and unexpectedly good compressive shrinkage results are able to be achieved in a two-roll, differential speed mechanical compactor when utilizing a specific combination of feeding and retarding rollers. In particular, the compressive shrinkage equipment is of the general type disclosed in the aforementioned Eugene Cohn et al U.S. Pat. No. 3,015,145. However, pursuant to the present invention, the just-described mechanical compacting machine has been modified to incorporate a specific combination of feeding and retarding rollers, which have been found through extended experimentation to be specifically and surprisingly effective in the processing of woven gauze bandage material.

More specifically, the present invention is based on the discovery that commercially successful mechanical compacting results may be achieved with woven gauze bandage material when the two-roll, differential speed compactor is modified so as to utilize, in combination, a retarding roller formed with a diamond knurl surface pattern of approximately 40 pitch and the opposing feed roller is formed with a straight knurl surface pattern of approximately 80 pitch. This specific combination of feeding and retarding roller surface characteristics has been found to produce effective and desirable results, whereas other combinations of roller surface characteristics that logically should have been effective were found to be either ineffective or unable to sustain production for a reasonable time.

The use of the combination 40 pitch diamond knurl on the retarding roll and 80 pitch straight knurl on the feeding roll has, for the first time, enabled gauze bandage material to be mechanically compressively shrunk to achieve a product which is competitive with the product of the older slack mercerizing process. At the same time, moreover, the mechanical compressive shrinkage procedure provides significant practical and cost saving advantages over the mercerizing procedure, so that it becomes a significantly more attractive process overall.

For a more complete understanding of the above and other features and advantages of the invention, reference should be made to the following description of a preferred embodiment and to the accompanying drawings.

DESCRIPTION OF THE DRAWINGS

FIG. 3 is a fragmentary cross sectional view as taken generally along line 3—3 of FIG. 2.

FIG. 4 is a fragmentary top plan view of the compactor apparatus of FIG. 1, with the compactor shoe removed, to illustrate details of the roller surface characteristics and the roller end construction.

DESCRIPTION OF A PREFERRED EMBODIMENT

Figure 1:
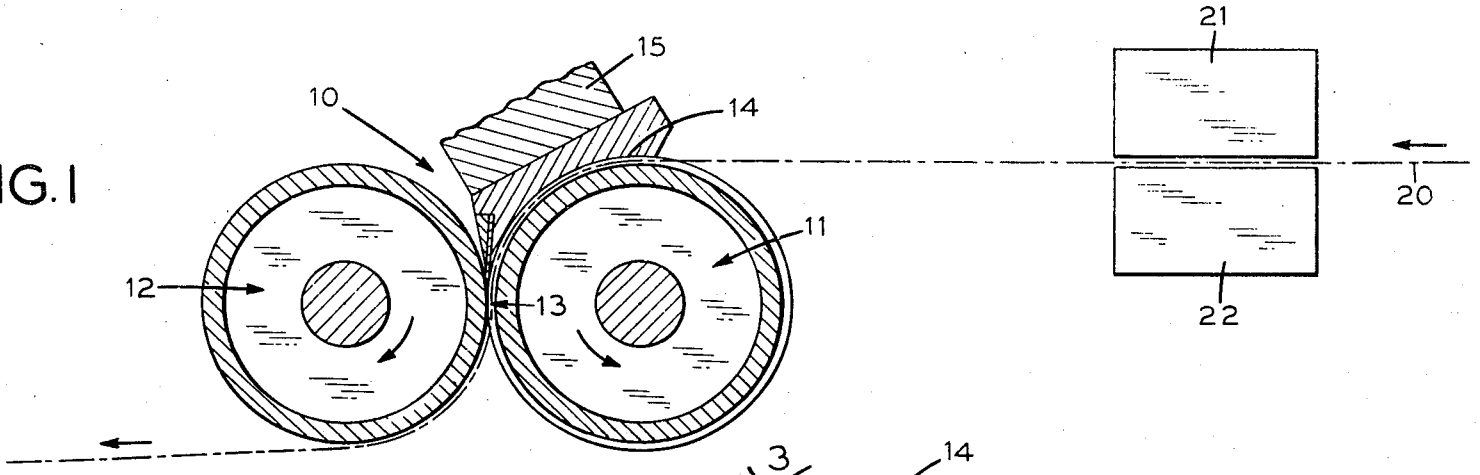
FIG. 1 is a simplified cross sectional representation of a two-roll, differential speed mechanical compacting system for the processing of woven gauze bandage material in accordance with the invention.
Figure 2:
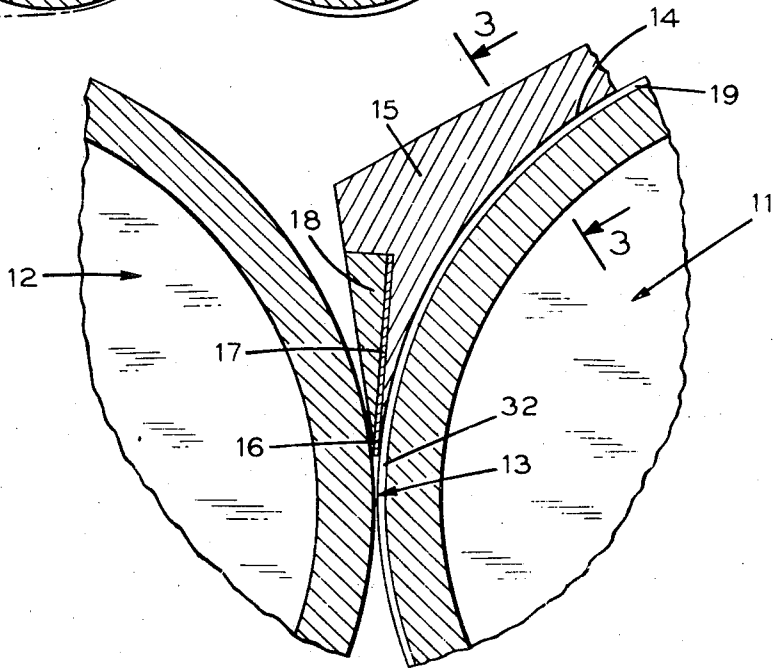
FIG. 2 is a highly enlarged, fragmentary illustration of the mechanism of FIG. 1, illustrating details of the compacting zone in which the mechanical compressive shrinkage occurs.

Referring now to the drawings, the reference numeral 10 designates generally a mechanical compacting station of the basic type described in the beforementioned Eugene Cohn et al U.S. Pat. No. 3,015,145. The compacting station includes a pair of opposed feeding and retarding rollers 11, 12, respectively, arranged to form a roller nip 13. Cooperating with the feeding and retarding rollers is a shoe 15 which includes an arcuate plate surface 14 which conforms to and closely embraces the outer surface of the feed roller 11 over a substantial arc. The compacting shoe 15 also includes a tip 16 formed by the terminal edge of a flat, thin blade 17 mounted in the shoe by a clamping plate 18. The shoe tip 16 is positioned to lie a short distance (e.g., typically less than ¼ inch) above or on the upstream side of the roller nip 13.

Pursuant to known techniques for the operation of two-roll, differential speed mechanical compacting equipment, the feeding and retarding rollers 11, 12 are speed adjustable, one with respect to the other, and appropriate controllable drive means (not shown) are provided for this purpose. Likewise, the compacting shoe 15 is adjustable with respect to the position of the shoe tip 16 in relation to the roller nip and with respect to the relationship of the arcuate shoe surface 14 to the outer surface 19 of the feed roller. For this purpose, the apparatus of the invention may advantageously incorporate mechanisms of the type described in the Diggle U.S. Pat. No. 3,973,303.

In the processing of the gauze bandage material, continuous webs 20 of the material are drawn from a suitable source or sources (not shown), guided through opposed steam boxes 21, 22, and then through the compressive shrinkage station 10. Typically, gauze bandage material comes in relatively narrow width, such as 4 inches, in which case an economical commercial processing operation might involve simultaneous processing of a plurality of strips in side-by-side relation. In addition, it is frequently desired to produce the bandage material in multiple ply arrangement. Both two-ply and six-ply material are marketed commercially. In such cases, the webs 20 will consist of multiple ply material, with all plies being processed simultaneously. In any case, the maximum thickness of the multiple ply bandage material prior to compacting is very thin, on the order of 0.012 inch.

In accordance with a significant aspect of the invention, effective mechanical compressive shrinkage of the gauze bandage material requires the respective feeding and retarding rollers 11, 12 to have predetermined surface characteristics. Specifically, the feeding roller 11 is provided with a straight knurl surface pattern 23 (see FIG. 4) of approximately 80 pitch. The retarding roller 12, on the other hand, is formed with a diamond knurl surface pattern 24 of approximately 40 pitch. The straight and diamond knurl patterns are formed with conventional, commercially available knurling equipment, according to well known practices. In an advantageous practical embodiment of the invention, the feeding and retarding rollers, in the form of hollow steel cylinders, may have an initial machined and ground outside diameter of about 4.916 inches, held to very tight tolerances. In the forming of the feeding roller, a standard 80 pitch straight knurl tool is utilized, and the surface is knurled to the full depth of the tool or until the roll outside diameter in the area of the knurl increases to 4.921 inches. The retarding roll, on the other hand, is machined with a 40 pitch standard diamond knurling tool, and is knurled to the full depth of the tool or until the knurled area of the roller increases to an outside diameter of 4.926 inches. In the case of both the feeding and retarding rolls 11, 12, the knurled area extends over the full working surface of the rollers. That is, the full area that will be in contact with the gauze bandage material during processing operations. Typically, the knurling will extend for substantially the full length of the rollers. After knurling, the rollers desirably are heat treated to increase hardness.

As reflected particularly in FIGS. 3 and 4, the feeding roller 11 is provided at its opposite ends with recessed shoulders 25 on which are received bearing ring assemblies 26. Bearing rings 26 typically consist of inner race rings 27 and outer race rings 28, the latter being supported by a plurality of needle bearings 29 and secured in place on the ends of the feeding roller 11 by a retainer plate 30, bolted to the roller at each end. Nominally, the bearing rings 26 have a diameter approximately 0.008 inch greater than the knurled diameter of the feeding roller 11.

Pursuant to the invention, the confining shoe 15 extends over the full working length of the feed roller 11 and sufficiently beyond so as to overlie the bearing rings 26 at opposite ends of the feed roller. The arrangement is such that the confining shoe and the blade 17 which forms the shoe tip 16, may be brought to bear against the rings 26, providing a limit of inward adjustment of the shoe so as to maintain a minimum clearance between the internal, arcuate shoe surface 14 and the knurled outer surface of the feed roller 11. By appropriate adjustment of the confining shoe 15, the confining surface 14 may be adjusted so at least the terminal area thereof is set to within approximately 0.003 inch from the feed roll with no gauze bandage material in the machine. This small clearance is substantially less than the initial thickness of the gauze bandage material prior to compacting, which may be in some cases up to a maximum of 0.012 inch.

In the apparatus of the invention, the clearance between the feed roll and the retarding roll is adjusted to provide an extremely narrow roller nip space 13, desirably as little as 0.001 inch and, in any event, less than the gap setting of the confining shoe 15. Since the nip spacing is substantially less than the radial projection of the bearing rings 26, it is necessary to provide for at least some recess in the retarding roller 12, in the area 31 directly opposite the bearing ring. Because the clearance space between the feeding and retarding rollers 11, 12 is so fine, it is generally impracticable to rely upon bearing rings to maintain a minimum separation between the rollers. However, additional bearing rings could be employed on the retarding roller 12, provided such bearing rings were slightly smaller in outside diameter than the roller itself, so as to accommodate the radial projection of the feed roller bearing rings 26.

In a typical bandage processing operation according to the invention, multiple widths of two-ply bandage material 20 are drawn from a reel or other source in side-by-side relation. These widths are passed through the steam boxes 21, 22 and advanced into a compacting zone 32, formed primarily by the blade tip 16 and roller nip 13. Advancement of the fabric is effected by the grip exerted on the bandage material by the 80 pitch straight knurled surface of the feed roller 11 in the arcuate region (around 90°) over which the shoe 15 conforms to the surface of the feed roller. As the gauze bandage material is advanced to the roller nip 13, it is engaged by the 40 pitch diamond knurl outer surface of the retarding roll 12, which exerts a somewhat more effective grip on the bandage material than does the surface of the feeding roller. In the immediate region of the roller nip 13, the bandage material will, of course, be acted upon simultaneously by the feeding and retarding rollers 11 and 12. Since the retarding roller is moving at a surface speed substantially less than that of the feeding roller — as much as 50% or 60% less in some cases, there is substantial differential action on the opposite sides of the bandage material at the roller nip. It is intended that the bandage material be primarily influenced by the retarding roller 12 and thus decelerated substantially to the surface speed of the retarding roller. At the same time, it is intended that the bandage material be advanced along by the surface of the feeding roller 11, substantially at a much higher surface speed thereof, up until the region of the shoe tip 16. The decelerating action of the fabric occurs primarily in the short zone between the shoe tip 16 and the roller nip 13, and the desired longitudinal compressive shrinkage action occurs primarily in this zone. In the roller nip itself, the bandage material is subjected to relatively heavy localized rolling pressure.

The feeding and retarding rollers are internally heated by steam and, if desired, the confining shoe 15 may also be independently heated. The combination of this heat, the heavy rolling pressure at the nip, and the increased moisture content imparted to the fabric by the steam boxes 21, 22, serves to set the bandage material in its compressively shrunk condition, so that a significant percentage of the compressive shrinkage occurring within the zone 32 is retained in the material as it exits on the discharge side of the roller nip 13.

After discharge from the roller nip 13, the compressively shrunk bandage material is gathered, typically by rolling in a relatively tension free condition for packaging and eventual use.

In some instances, where extremely high bulk is desired, the bandage material may be utilized and processed in a six-ply form. Aside from minor adjustment of clearance spaces, the operation of the equipment and the processing of the bandage material is the same with the six-ply as with the two-ply material.

Typical gauze bandage material for use in the practice of the invention is formed of 100% cotton yarn of approximately 30's count in the warp and 40's count in the filling. The material is constructed with a very loose, open weave, comprising about 20 warp threads per inch and about 12 filling threads per inch. In this respect, the gauze bandage material, at least prior to processing, is conventional.

Particularly significant to the successful processing of the gauze bandage material is the selected combination of processing roller surface characteristics. The combination of relatively coarse diamond knurl surfacing of the retarding roller in conjunction with the relatively finer straight knurl surfacing of the feed roller is unconventional but surprisingly and unexpectedly effective in the specific application intended. In this respect, attempts to longitudinally compressively shrink the gauze bandage material with conventional roller combinations, and even many unconventional ones, have proved to be unsuccessful, either from the standpoint of unsuitable processing results, extremely rapid breakdown of the rollers, or combinations of both. With the specific selection of 40 pitch diamond knurled retarding roller and 80 pitch straight knurled feed roller, however, highly effective compressive shrinkage results are achieved and adequate roller life is able to be realized.

Among the advantageous characteristics imparted to the bandage material when processed according to the invention is a relatively high degree of crimp and physical bulk. This is highly desirable for the bandage material. Likewise, it is readily possible with the apparatus of the invention to impart to the gauze material as much as 40% stretch in the warp direction, which is also highly desirable for the intended use of the compacted fabric as a bandage material.

The apparatus of the invention enables the characteristics of bulk and stretch to be imparted to gauze bandage material by a mechanical process, as distinguished from chemical processing heretofore utilized. Many important advantages are realized from this, among them being greatly increased processing speeds, lack of pollution, less handling of the material, and maintenance of bandage width during processing. As regards speed of processing, mechanical compressive shrinkage of the bandage material according to the invention may be carried out at rates up to 80 yards per minute, far in excess of the rate at which the material may be processed by slack mercerizing. In the mechanical processing, only steam is applied to the fabric, and that is not a polluting material. In contrast, with slack mercerizing, the bandage material is treated with sodium hydroxide, which presents a disposal problem. Of additional significance, slack mercerizing of the bandage material results in dimensional reductions in both the length and the width directions, whereas mechanical compressive shrinkage is carried out without loss of fabric width. With bandage material, since lengthwise stretch is the characteristic primarily desired, economic advantages are achieved by being able to process the material without loss of width.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In a mechanical compacting apparatus for longitudinally compressively treating lightweight, woven gauze bandage material, of the type comprising (a) a generally cylindrical feeding roller for engaging and forwardly advancing the gauze, (b) a generally cylindrical retarding roller monted in opposed relation to said feeding roller and forming therewith a roller nip, (c) an arcuate confining shoe closely embracing the surface of said feeding roller over a substantial arc, (d) said confining shoe having a discharge edge located close to said nip and defining therewith a compacting zone, (e) means for driving said feeding and retarding rollers such that the feeding roller has a higher surface speed than that of the retarding roller; the improvement characterized by (f) said retarding roller being of metal construction and being formed with a diamond pattern surface knurl of about 40 pitch over its effective working surface area, (g) said feeding roller being of metal construction and being formed with a straight pattern surface knurl of about 80 pitch over its entire working surface area;

(h) said straight knurl being so formed that the knurl pattern extends generally parallel to the axis of said feeding roller, (i) said feeding roller having circumferentially extending surface-forming means at each end thereof and projecting radially beyond the working surface of the feeding roller, (j) said surface-forming means providing a limit stop for positioning of said confining shoe in a predetermined minimum spaced relation to the working surface of the feeding roller, (k) said roller nip being of smaller dimensions than the space between said feeding roller and said shoe, and (l) said retarding roller being recessed in the areas opposite to said surface-forming means.

2. In a mechanical compacting apparatus for longitudinal compressively treating lightweight, woven gauze bandage material, of the type comprising (a) a generally cylindrical feeding roller for engaging and forwardly advancing the gauze, (b) a generally cylindrical retarding roller mounted in opposed relation to said feeding roller and forming therewith a roller nip, (c) an arcuate confining shoe closely embracing the surface of said feeding roller over a substantial arc, (d) said confining shioe having a discharge edge located close to said nip and defining therewith a compacting zone, (e) means for driving said feeding and retarding rollers such that the feeding roller has a higher surface speed than that of the retarding roller; the improvement characterized by (f) said retarding roller being of metal construction and being formed with a diamond pattern surface knurl of about 40 pitch over its effective working surface area, (g) said feeding roller being of metal construction and being formed with a straight pattern surface knurl of about 80 pitch over its entire working surface area, (h) said straight knurl being so formed that the knurl pattern extends generally parallel to the axis of said feeding roller, (i) said feeding roller having bearing rings at each end projecting radially beyond the working surface of the feeding roller, (j) said bearing rings forming a limit stop for positioning of said confining shoe in relation to said feeding roller, (k) said roller nip being of smaller dimensions than the space between said feeding roller and said shoe, and (l) said retarding roller being recessed opposite to said bearing rings.

* * * * *